US007250723B1

(12) United States Patent
Foster

(10) Patent No.: US 7,250,723 B1
(45) Date of Patent: Jul. 31, 2007

(54) CATHODE LUMINESCENCE LIGHT SOURCE FOR BROADBAND APPLICATIONS IN THE VISIBLE SPECTRUM

(75) Inventor: John E. Foster, Strongsville, OH (US)

(73) Assignee: The United States of America as represented by the Administrator of NASA, Washington, DC (US)

( * ) Notice: Subject to any disclaimer, the term of this patent is extended or adjusted under 35 U.S.C. 154(b) by 392 days.

(21) Appl. No.: 11/016,735

(22) Filed: Dec. 21, 2004

(51) Int. Cl.
*H01J 17/49* (2006.01)

(52) U.S. Cl. ..... 313/582

(58) Field of Classification Search ..... 313/581, 313/582, 586, 231.31, 484, 491
See application file for complete search history.

(56) References Cited

U.S. PATENT DOCUMENTS

| | | | | |
|---|---|---|---|---|
| 3,612,686 | A | 10/1971 | Braman et al. | |
| 3,710,125 | A | 1/1973 | Jacobs et al. | |
| 3,848,248 | A * | 11/1974 | MacIntyre, Jr. | 345/60 |
| 3,860,846 | A * | 1/1975 | Mayer | 313/491 |
| 3,911,315 | A | 10/1975 | Todd, Jr. et al. | |
| 4,295,989 | A | 10/1981 | Klein et al. | |
| 4,513,025 | A | 4/1985 | Clark et al. | |
| 4,814,105 | A | 3/1989 | Oversluizen et al. | |
| 4,851,735 | A | 7/1989 | Gosslar et al. | |
| 5,155,668 | A | 10/1992 | Tanner et al. | |
| 5,453,305 | A | 9/1995 | Lee | |
| 6,136,226 | A | 10/2000 | Sakai | |
| 6,693,377 | B1 | 2/2004 | Mueller et al. | |
| 2003/0183807 | A1 | 10/2003 | Shankar et al. | |

FOREIGN PATENT DOCUMENTS

| | | |
|---|---|---|
| JP | 60220544 A | 11/1985 |
| JP | 63266729 A | 11/1988 |
| WO | 94/00867 | 1/1994 |

* cited by examiner

*Primary Examiner*—Vip Patel
(74) *Attorney, Agent, or Firm*—Arlene P. Neal; Kent N. Stone

(57) ABSTRACT

A device and method for generating cathode luminescence is provided. The device and method generate broad spectrum electromagnetic radiation in the visible. A layer of particles, such as quartz or alumina powder, is exposed to electrons in a plasma discharge. Surface excitation of these particles or the generations/excitation of F-center sites give rise to luminescence.

26 Claims, 10 Drawing Sheets

CATHODE LUMINESCENCE LIGHT SOURCE FOR BROADBAND APPLICATIONS IN THE VISIBLE SPECTRUM

ORIGIN OF THE INVENTION

The invention described herein was made by an employee of the United States Government and may be manufactured and used by or for the Government for Government purposes without the payment of any royalties thereon or therefore.

BACKGROUND OF THE INVENTION

1. Field of the Invention

The present invention relates to a device and method for a cathode luminescence light source. Cathode luminescence involves the emission of non-thermal light occurring at low temperatures. In general, cathode luminescence is caused by the impact of energetic electrons upon a solid.

2. Description of the Related Art

Luminescence is light from non-thermal sources of energy, which can take place at normal and lower temperatures. As mentioned above, luminescence is caused by the impact of energetic electrons upon a solid. These electron impacts can generate dislocations in the lattice of the solid that is subsequently occupied by an electron, which forms an F-center. These F-centers are then excited through absorption of energy. De-excitation of the electrons results in the emission of photons thereby producing the luminescence.

Presently, a broadband emission is typically achieved via black bodies. Black body filament sources require operation at very high temperatures and consequently have inherent lifetime limitations. Temperatures in such sources are achieved typically by resistive heating which is not particularly efficient as well. High pressure lamps, which utilize pressure broadening, are also used to achieve broad band profiles. Such lamps utilize high pressure arcs and are not readily implementable in compact electronic devices. Additionally, handling requirements prevail (bulbs can explode if mishandled). As a result of these characteristics, such prior art solutions cannot be used for certain lighting applications. Therefore, there is a need for a device and method which provides a broadband spectrum which achieves intense luminescence, while utilizing very low voltages. The present invention provides a high intensity emission and blackbody-like profile similar to solar light. At the same time, the present invention does not require high pressure or high temperature to achieve a continuous radiation profile

SUMMARY OF THE INVENTION

According to one aspect of the invention, a light emitting device is provided. The light emitting device includes a plasma source for providing a plasma discharge, and a layer of non-conductive material. The light emitting device emits broadband spectrum electromagnetic radiation when the non-conductive material is exposed to the plasma discharge.

According to another aspect of the present invention, a method for emitting light is provided. The method includes the steps of establishing a plasma discharge from a plasma source, providing a layer of non-conductive material on a powder holding electrode, establishing an electron accelerating sheath at the surface of the powder holding electrode, and exposing the layer of non-conductive material to the plasma discharge. The layer of non-conductive material may be quartz or alumina powder. The layer of quartz or alumina powder interacts with the plasma discharge to produce a broadband spectrum of electromagnetic radiation.

BRIEF DESCRIPTION OF THE DRAWINGS

For the present invention to be easily understood and readily practiced, the present invention will now be described, for purposes of illustration and not limitation, in conjunction with the following figures.

DETAILED DESCRIPTION OF THE PREFERRED EMBODIMENT(S)

Reference will now be made in detail to the preferred embodiments of the present invention, examples of which are illustrated in the accompanying figures.

Figure 1:
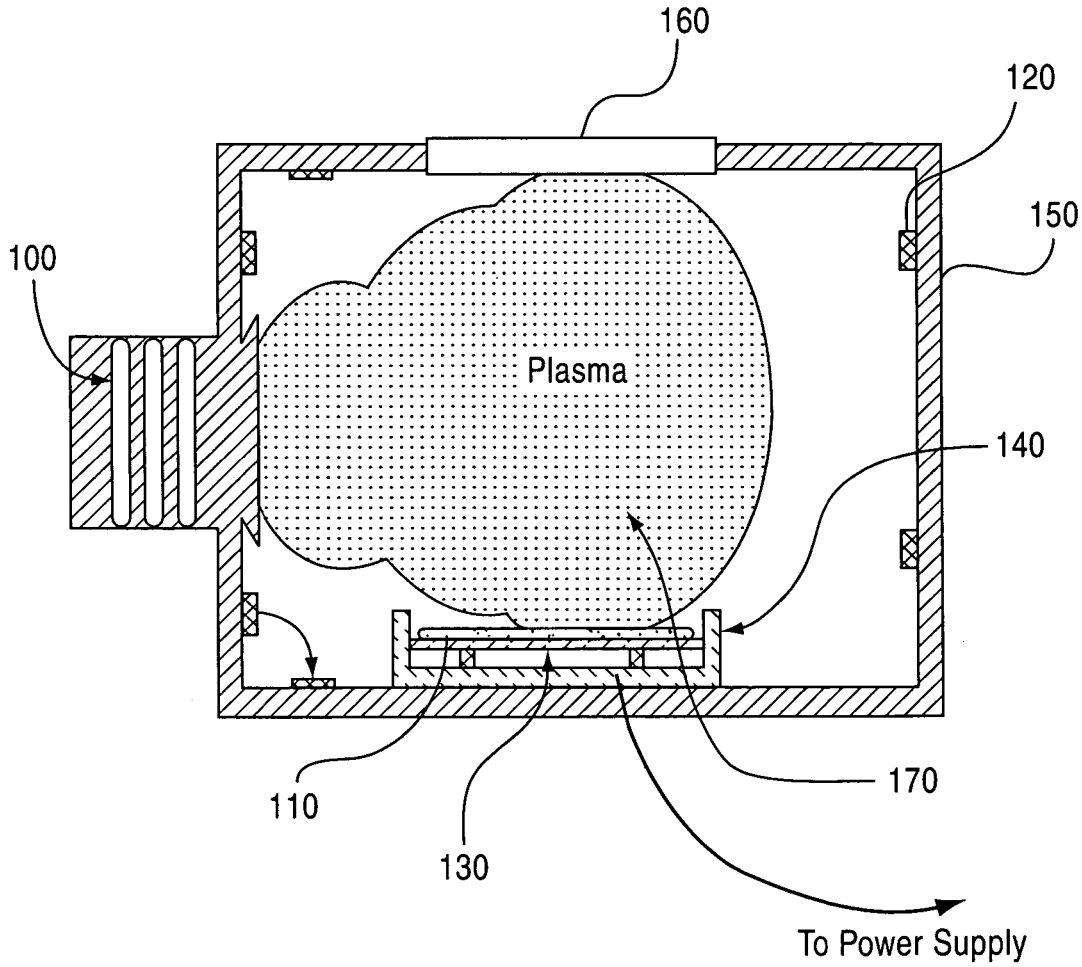
FIG. 1 illustrates a device according to one embodiment of the invention.

FIG. 1 illustrates the device according to one embodiment of the invention. The device illustrated produces cathode luminescence of the particle layer 110 when the powder holding electrode 140 is exposed to the plasma sheath 170 and then biased positively relative to ground potential via a bias plate 130. According to one aspect of the invention, the powder holding electrode 140 receives a bias voltage from a power source. More specifically, a plasma source 100 is provided for the generation of a low pressure discharge plasma 170 containing electrons into a discharge chamber 150. A plasma sheath is formed at the surface of the particle layer. The potential difference across this sheath accelerates the electrons into the powder layer.

The particle layer 110 is exposed to the electrons thereby giving rise to surface excitation of the powder. According to one embodiment of the invention, the particle layer 110 is comprised of particles such as quartz powder or alumina powder. The powder may include particles with small particle sizes and high surface to volume ratios. According to one embodiment of the invention, the quartz or alumina powder may have an average diameter of 45 microns. In general, small particles with high surface area to volume ratio can be utilized to maximize the effective surface on which the electrons interact. Additionally, the particle layer may be spray coated on a metal substrate.

The emission of light may be observed through a quartz window 160 located on the discharge chamber 150. The dust holding electrode device utilizes magnets 120 arranged with alternating polarity, such that the electrons can only move along the field lines. The magnets serve to intensify and concentrate electron flux so as to enhance and intensify the emission. These magnets also serve to improve plasma source efficiency by increasing electron utilization path length and reducing the electron loss rate to the walls. The most intense emission occurs at the magnetic cusps, since electron collection occurs primarily at the center of the magnetic cusps. The resulting spectrum is broadband, extending over the visible and into the near infrared. Additionally, the voltage utilized in the present invention to achieve intense luminescence is relatively low (i.e. less than 1 kV).

Figure 8A:
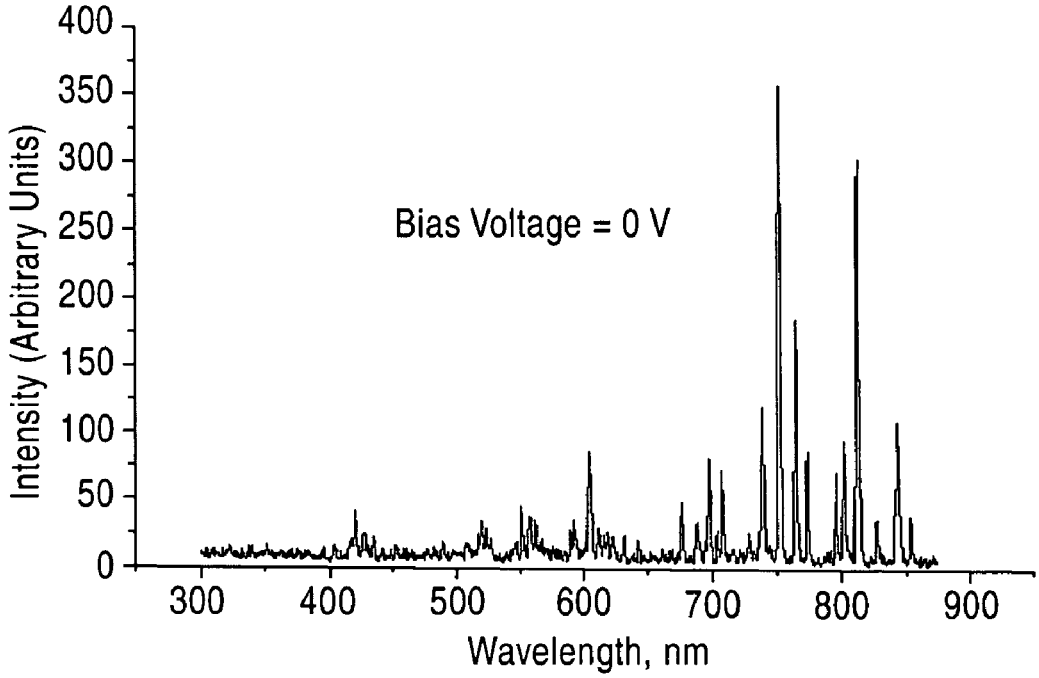
FIG. 8 is a graph which illustrates the variation in the measured emission spectra as a function of bias voltage.
Figure 8B:
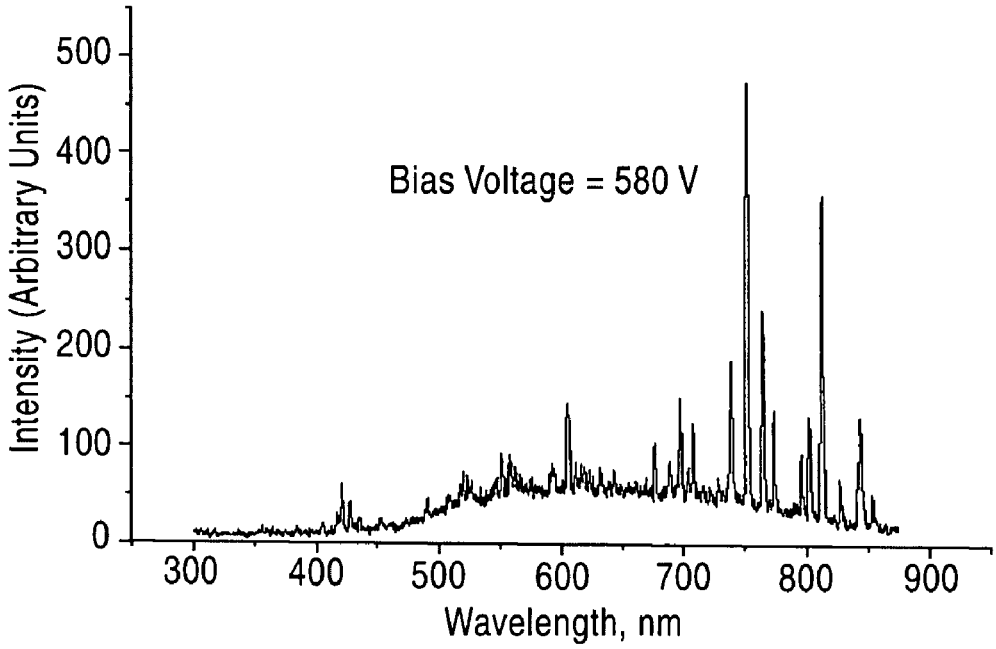
Figure 8C:
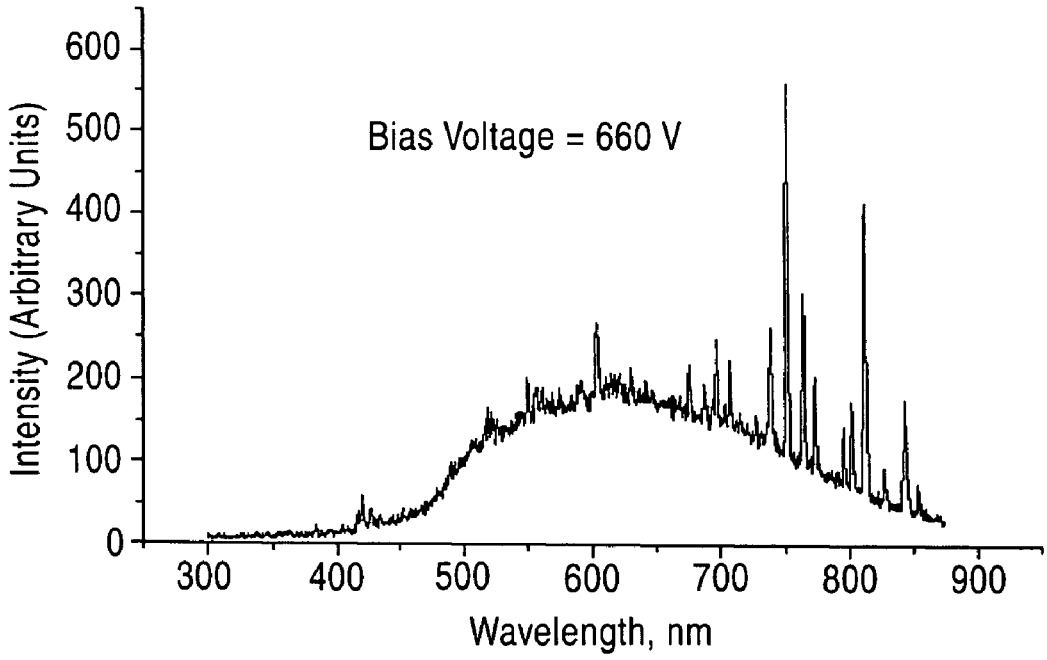

FIGS. 8*a*, 8*b*, and 8*c* are graphs illustrating the variation in the measured emission spectra of the present invention as a function of bias voltage. Without a bias voltage, as illustrated in FIG. 8*a*, the emission spectra is characterized as line spectra typical of a low pressure argon plasma discharge. As the bias voltage increases, however, the baseline is distorted. FIGS. 8*b* and 8*c* depict the emission spectra with a bias voltage of 580 volts and 660 volts, respectively.

Figure 2A:
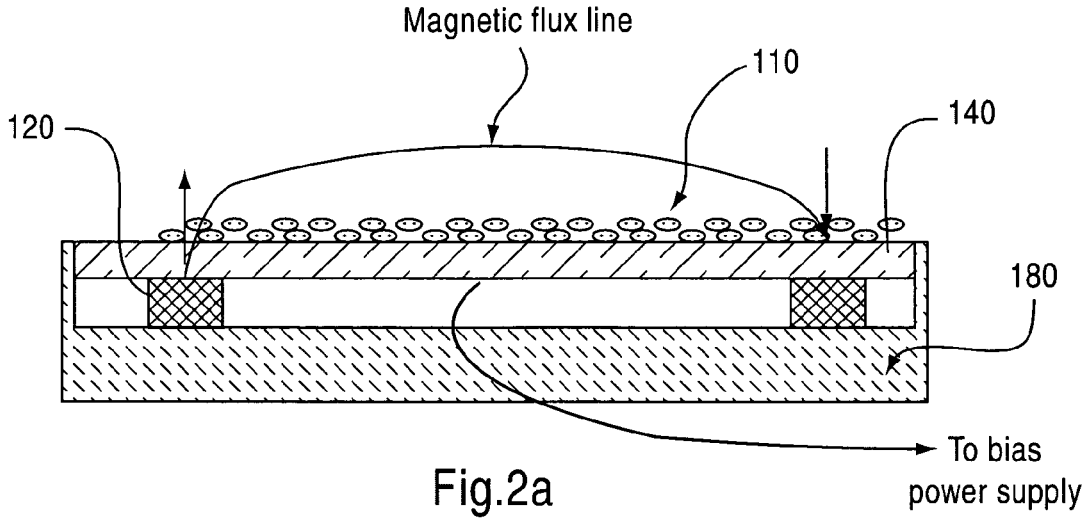
FIG. 2 illustrates a powder holding electrode according to one embodiment of the present invention.
Figure 2B:
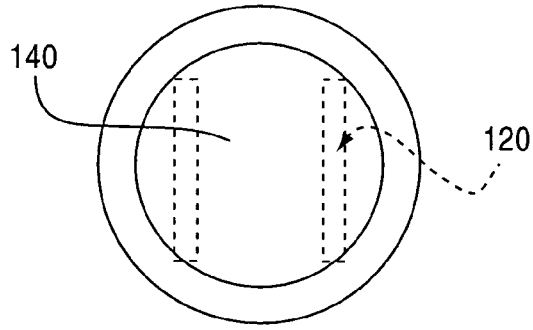

FIG. 2*a* is a more detailed illustration of the powder holding electrode 140. The powder holding electrode is comprised of a cup 180, which may be ceramic, an electrode 190, magnets 120, and the particle layer 110. The powder holding electrode 140 may be biased between the floating potential to +1 kV relative to ground. FIG. 2*b* illustrates a top view of the powder holding electrode that is illustrated in FIG. 2*a*.

Figure 3A:
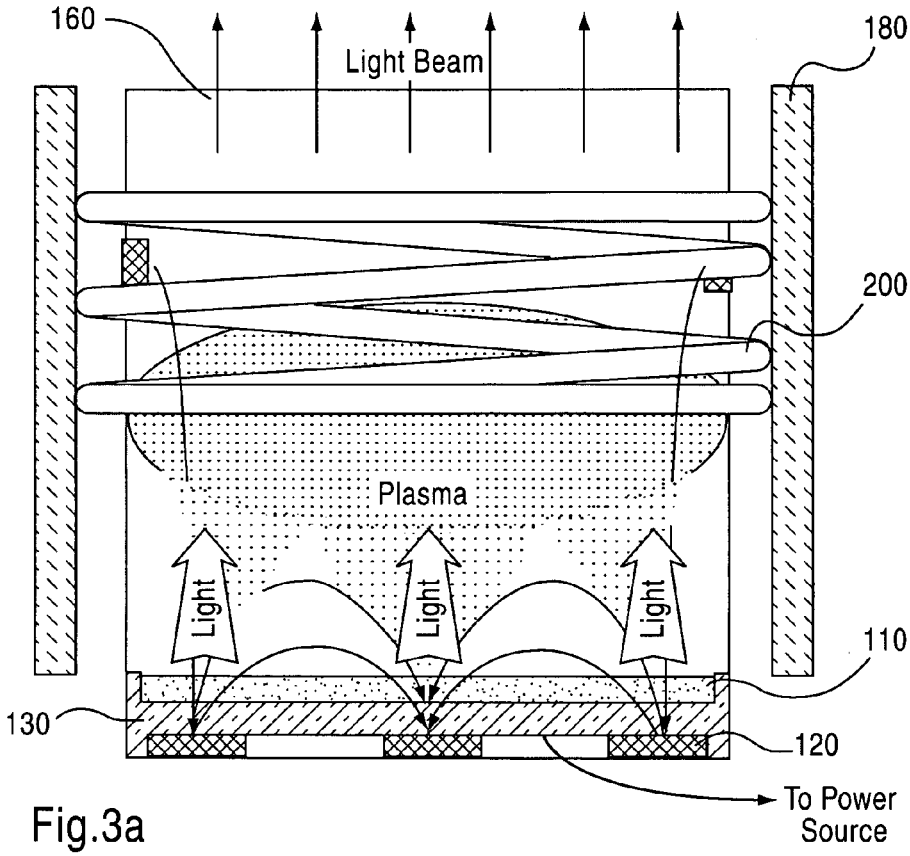
FIG. 3 illustrates a device according to an embodiment of the invention, where an RF coil is provided as a plasma source.
Figure 3B:
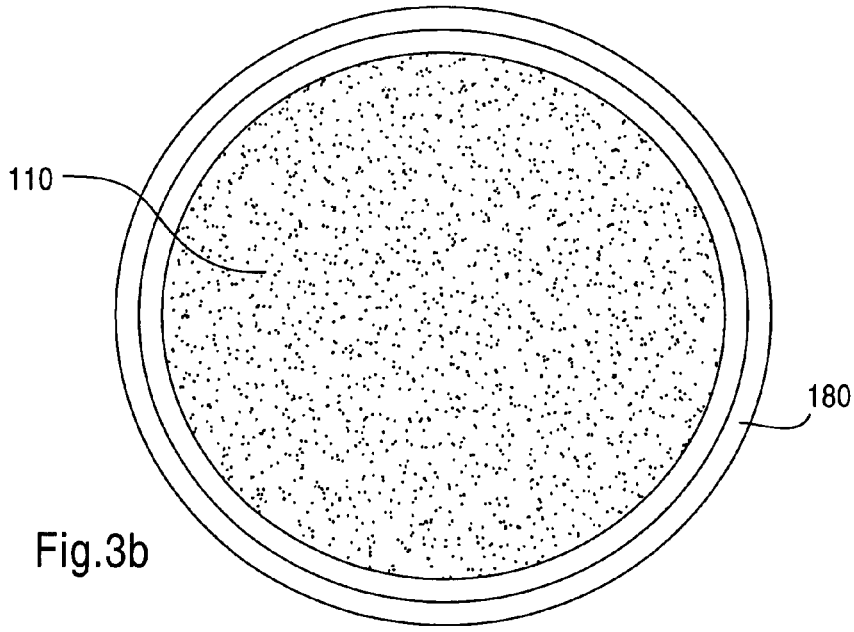

FIG. 3*a* illustrates the device according to another embodiment of the invention. More specifically, FIG. 3*a* illustrates a radio frequency (RF) coil which serves as a plasma source in this embodiment. Electrons within the plasma interact with the particle layer 110 resulting in a plasma-induced emission of light. The particle layer 110 may be comprised of quartz or alumina powder. Magnets 120 are provided and serve to concentrate electron flux resulting in an enhanced emission. A bias plate 130 is also provided. FIG. 3*b* is a top view of the device illustrated in FIG. 3*a*.

Figure 4A:
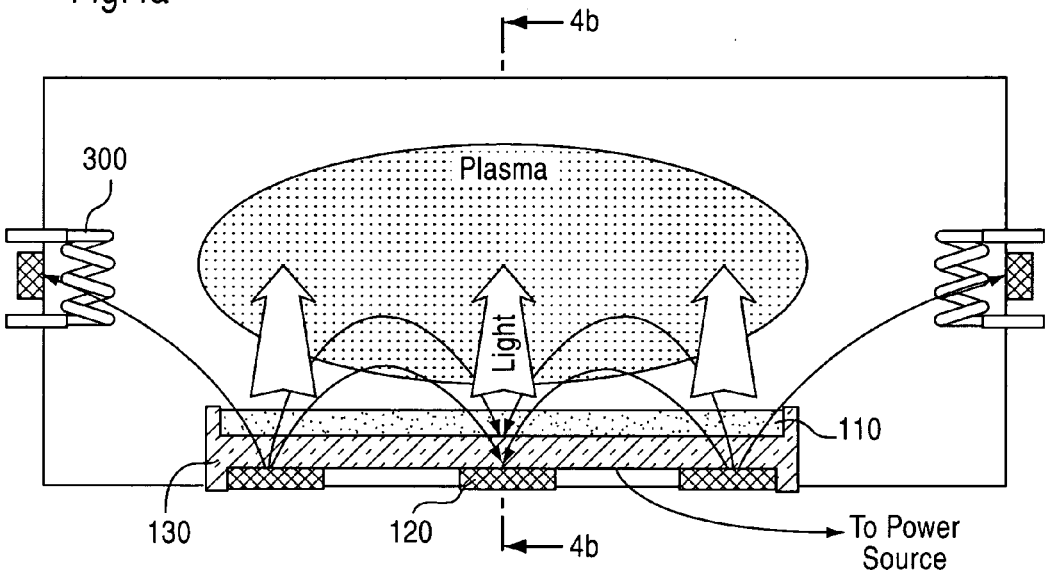
FIG. 4 illustrates a device according to an embodiment of the invention, where a filament cathode is provided as a plasma source.
Figure 4B:
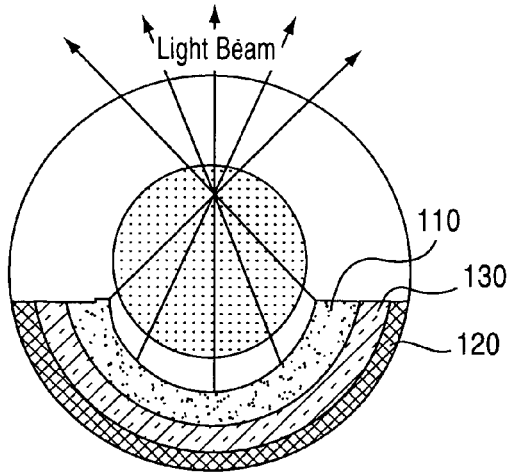

FIG. 4*a* illustrates an alternate embodiment of the present invention. A filament cathode 300 is provided. The filament cathode 300 provides the electrons for interaction with the particle layer 110 resulting in a plasma-induced emission of light. Again, the particle layer 110 may be comprised of quartz or alumina powder. The cathode may also be a hollow cathode or a field emission cathode. The device, according to FIG. 4*a*, also utilizes magnets 120 with alternating polarity such that the electrons can only move along the field lines resulting in enhanced and intense emission. A bias plate 130 is also provided. FIG. 4*b* illustrates a cross section of the device illustrated in FIG. 4*a*, along the line 4.

Figure 5A:
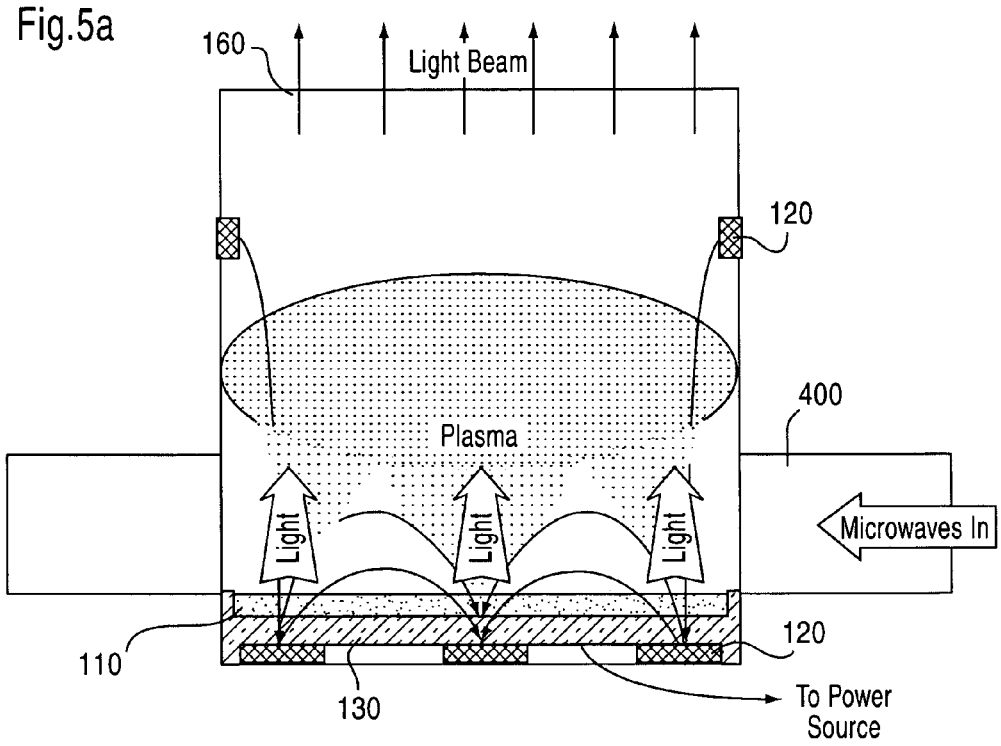
FIG. 5 illustrates a device according to another embodiment of the invention, where microwaves are provided as a plasma source.
Figure 5B:
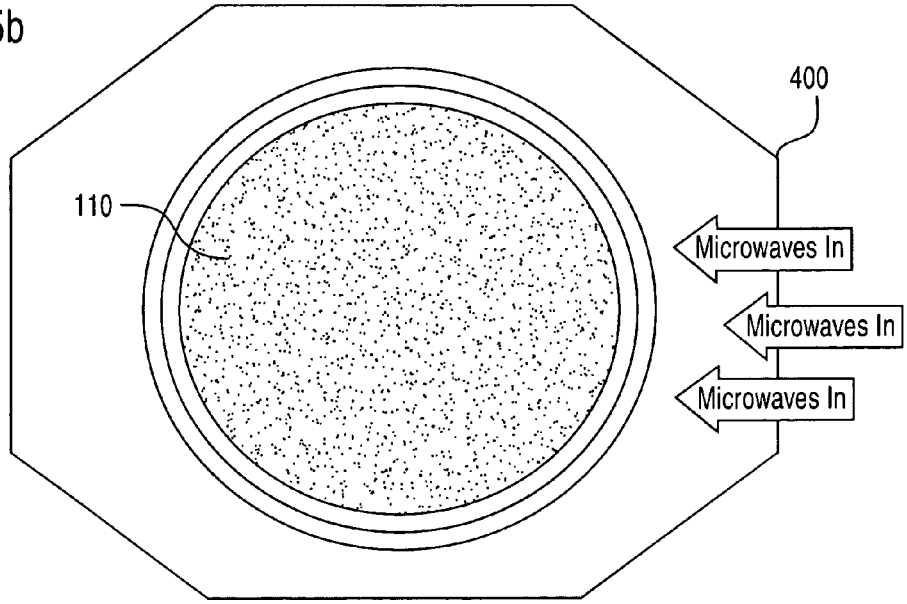

FIG. 5*a* illustrates the device according to another embodiment of the present invention. Specifically, FIG. 5*a* illustrates a microwave cavity 400, such that the microwave cavity 400 drives electron cyclotron resonance heating at the magnetic cusps 120 generating the plasma electrons necessary to excite the particle layer 110 resulting in a plasma-induced emission of light. The resulting spectrum is broadband, extending over the visible and into the near infrared.

Figure 6:
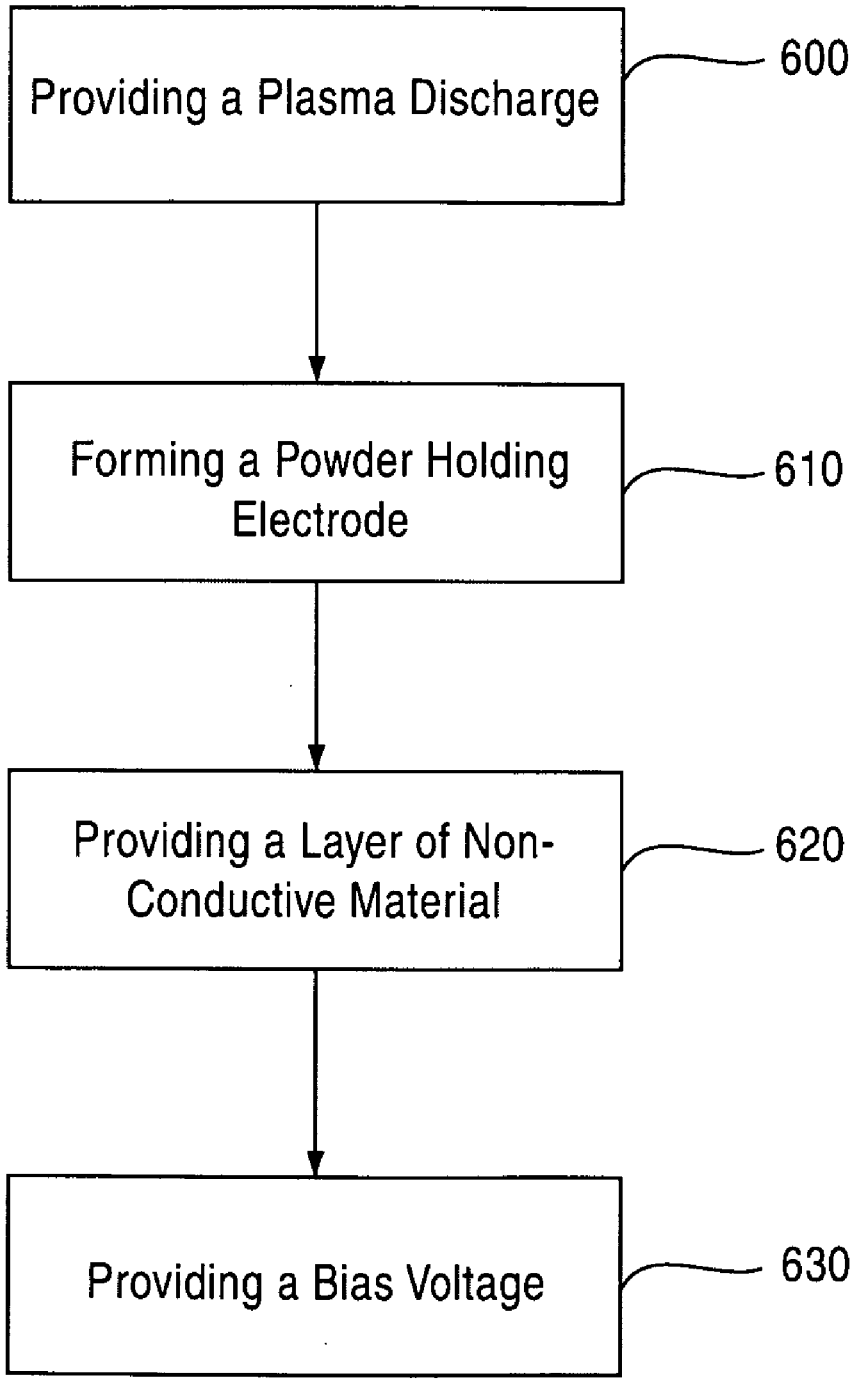
FIG. 6 illustrates a method according to one embodiment of the present invention.

FIG. 6 illustrates a method for emitting light according to one embodiment of the invention. The method includes the steps of providing a plasma discharge 600, forming a powder holding electrode 610, and providing a layer of non-conductive material within the powder holding electrode 620. A plasma source establishes a plasma discharge resulting in an electron sheath at the surface of the powder holding electrode where a layer of non-conductive material is provided. The layer of non-conductive material interacts with said plasma discharge to produce a broadband spectrum of electromagnetic radiation. The method may further include the step of providing a bias voltage 630.

Figure 7:
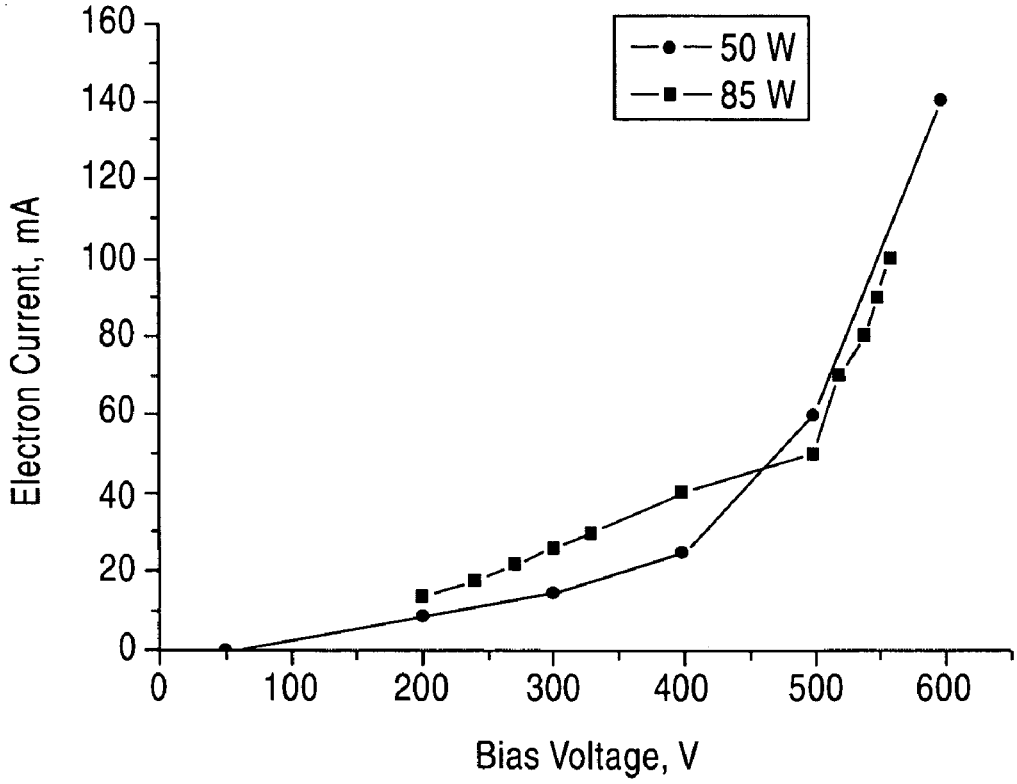
FIG. 7 is a graph which illustrates variations in the electrode current as a function of bias voltage.

The cathode luminescence emitted by the present invention increases as the bias voltage is increased from 0 volts to 600 volts. Additionally, the bias current to the electrode increases with increasing bias voltage. FIG. 7 illustrates variations in the electrode current as a function of bias voltage. FIG. 7 illustrates this variation at a 50 watt input rf power level and an 85 watt input rf power level. The current to the powder holding electrode 140 increases with increasing bias voltage. At 500 volts, however, the current begins to increase at a much larger rate with increasing voltage. As a result, the light emission from the particle layer 110 is most intense at voltages above 500 volts. This behaviour is related to a transition into a regime where secondary electrons are being produced. These electrons can also contribute to the luminesence processes.

The emission provided by the current invention is purely luminescent. Normally, however, the emission profile produced by the present invention is only achievable via a hot blackbody at an emission temperature higher than conventional filament melting points. Consequently, the invention is able to produce intense luminescence, similar to that of a hot black body, while utilizing very low voltages. Furthermore, the present invention may be used as a broadband light source, while eliminating the need for a hot source or a high pressure discharge.

As a result of these characteristics of the present invention, it may be employed in a wide range of lighting applications. For instance, the present invention can be used in backlighting for liquid crystal display (LCD) monitors or televisions, soft decorative lighting, green house applications, spectroscopy and other similar applications. The backlighting applications may be implemented via the use of field emission cathodes similar to that used in plasma screen televisions.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

I claim:

1. A light emitting device, comprising:

a plasma source for providing a plasma discharge;

a layer of non-conductive material;

wherein said light emitting device emits broadband spectrum electromagnetic radiation when said non-conductive material is exposed to said plasma discharge.

2. The light emitting device according to claim 1, wherein the non-conductive material comprises quartz powder.

3. The light emitting device according to claim 1, wherein the non-conductive material comprises alumina powder.

4. The light emitting device according to claim 1, wherein the plasma source comprises a radio frequency (rf) excited plasma source.

5. The light emitting device according to claim 1, wherein the plasma source comprises a microwave source.

6. The light emitting device according to claim 1, wherein the plasma source comprises a filament cathode.

7. The light emitting device according to claim 6, wherein the filament cathode is a hollow cathode.

8. The light emitting device according to claim 6, wherein the filament cathode is a field emission cathode.

9. The light emitting device according to claim 1, wherein the plasma discharge is sustained using an antenna.

10. The light emitting device according to claim 1, further comprising a powder holding electrode.

11. The light emitting device according to claim 1, further comprising a plurality of magnets.

12. The light emitting device according to claim 1, wherein said plasma discharge comprises an inert gas plasma discharge.

13. The light emitting device according to claim 12, wherein said inert gas plasma discharge comprises a low pressure argon plasma discharge.

14. The light emitting device according to claim 12, wherein said inert gas plasma discharge comprises an argon plasma discharge.

15. The light emitting device according to claim 12, wherein said inert gas plasma discharge comprises a xenon plasma discharge.

16. The light emitting device according to claim 1, further comprising a power source.

17. A method for emitting light, said method comprising the steps of:

establishing a plasma discharge from a plasma source;

providing a layer of non-conductive material on a powder holding electrode;

establishing an electron accelerating sheath at the surface of the powder holding electrode;

exposing said layer of non-conductive material to the plasma discharge;

wherein the exposing step results in a production of a broadband spectrum of electromagnetic radiation.

18. The method of claim 17, further comprising the step of providing a bias voltage to the powder holding electrode.

19. The method of claim 17, wherein said step of providing the layer of non-conductive material comprises providing a ceramic powder.

20. The method of claim 19, wherein said step of providing a ceramic powder comprises providing one of quartz powder and alumina powder.

21. The method of claim 19, wherein said step of providing a ceramic powder comprises providing a powder with high surface area to volume ratio.

22. The method of claim 17, wherein said step of establishing the plasma discharge comprises providing the plasma discharge using a radio frequency (rf) excited plasma source.

23. The method of claim 17, wherein said step of establishing the plasma discharge comprises providing the plasma discharge using a microwave source.

24. The method of claim 17, wherein said step of establishing the plasma discharge comprises providing the plasma discharge using a filament cathode plasma source.

25. The method of claim 17, wherein said step of establishing the plasma discharge comprises providing an argon plasma discharge.

26. A light emitting device, comprising:

plasma establishing means for establishing a plasma discharge;

forming means for forming a powder holding electrode;

first providing means for providing a layer of non-conductive material within said powder holding electrode;

second providing means for providing a bias voltage;

electron establishing means for establishing the formation of an electron accelerating sheath;

wherein the layer of non-conductive material interacts with said plasma discharge to produce a broadband spectrum of electromagnetic radiation.

* * * * *